US008757774B2

(12) United States Patent
Hanagami et al.

(10) Patent No.: US 8,757,774 B2
(45) Date of Patent: Jun. 24, 2014

(54) LIQUID EJECTING HEAD AND LIQUID EJECTING APPARATUS

(75) Inventors: Taiki Hanagami, Matsumoto (JP); Eiichiro Watanabe, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/474,071

(22) Filed: May 17, 2012

(65) Prior Publication Data

US 2012/0293585 A1 Nov. 22, 2012

(30) Foreign Application Priority Data

May 20, 2011 (JP) ..... 2011-114053

(51) Int. Cl.
*B41J 2/14* (2006.01)

(52) U.S. Cl.
USPC ..... 347/49; 277/644; 277/648

(58) Field of Classification Search
USPC ..... 347/47, 84, 85, 92; 277/644, 648, 649
See application file for complete search history.

(56) References Cited

U.S. PATENT DOCUMENTS

| | | | | |
|---|---|---|---|---|
| 5,056,799 | A * | 10/1991 | Takenaka et al. | 277/562 |
| 5,517,220 | A * | 5/1996 | English | 347/29 |
| 6,406,125 | B1 * | 6/2002 | Jackson | 347/35 |
| 6,454,399 | B2 * | 9/2002 | Ujita et al. | 347/92 |
| 7,018,026 | B2 * | 3/2006 | Yamada et al. | 347/86 |
| 7,147,228 | B2 * | 12/2006 | Tonkin | 277/321 |
| 7,465,040 | B2 * | 12/2008 | Malik et al. | 347/85 |
| 7,527,366 | B2 * | 5/2009 | Jones | 347/85 |
| 2002/0130917 | A1 * | 9/2002 | Mitsui et al. | 347/29 |
| 2003/0160841 | A1 * | 8/2003 | Takata et al. | 347/50 |
| 2005/0110836 | A1 * | 5/2005 | Colombat et al. | 347/50 |
| 2005/0140749 | A1 * | 6/2005 | Usui et al. | 347/84 |
| 2006/0092213 | A1 * | 5/2006 | Shindo et al. | 347/29 |
| 2007/0273737 | A1 * | 11/2007 | Uezawa | 347/92 |
| 2009/0073227 | A1 * | 3/2009 | Sakaida et al. | 347/42 |
| 2009/0085950 | A1 * | 4/2009 | Takata | 347/18 |
| 2009/0167821 | A1 * | 7/2009 | Sugahara | 347/68 |
| 2009/0217994 | A1 * | 9/2009 | Chen et al. | 137/605 |
| 2009/0244179 | A1 * | 10/2009 | Sugahara | 347/40 |
| 2010/0079538 | A1 * | 4/2010 | Ueno | 347/32 |
| 2011/0197991 | A1 * | 8/2011 | Ender et al. | 141/23 |
| 2011/0279599 | A1 * | 11/2011 | Borra et al. | 347/92 |
| 2012/0147088 | A1 * | 6/2012 | Nishida | 347/22 |

FOREIGN PATENT DOCUMENTS

| | | | |
|---|---|---|---|
| JP | 2000120879 A | * | 4/2000 |
| JP | 2011-056872 | | 3/2011 |

* cited by examiner

*Primary Examiner* — Matthew Luu
*Assistant Examiner* — Patrick King
(74) *Attorney, Agent, or Firm* — Harness, Dickey & Pierce, P.L.C.

(57) ABSTRACT

A liquid ejecting head includes: a main head unit that ejects ink; a first flow channel member and a second flow channel member that include first and second flow channels, respectively, through which ink to be supplied to the main head unit flows; and a ring-shaped sealing member pinched by the first flow channel member and the second flow channel member. The first flow channel and the second flow channel communicate with the interior of a space area defined by the first flow channel member, the second flow channel member, and the sealing member, and an atmosphere exposure channel that connects the space area with the exterior is formed in a joining surface between the sealing member and the first flow channel member.

14 Claims, 9 Drawing Sheets

LIQUID EJECTING HEAD AND LIQUID EJECTING APPARATUS

BACKGROUND

1. Technical Field

The present invention relates to liquid ejecting heads and liquid ejecting apparatuses, and particularly relates to ink jet recording heads and ink jet recording apparatuses that eject ink as a liquid.

2. Related Art

An ink jet recording head that ejects ink can be given as a representative example of a liquid ejecting head that ejects a liquid. An ink jet recording head that includes, for example, a plurality of main head units that eject ink through nozzle openings, and a first flow channel member and a second flow channel member provided with a first flow channel and a second flow channel, respectively, for supplying ink to the main head units, where a sealing member is provided between the first flow channel member and the second flow channel member, has been proposed (for example, see JP-A-2011-056872).

The sealing member is pinched by the first flow channel member and the second flow channel member and is compressed to a certain degree. Providing such a sealing member ensures that the area between the first flow channel member and the second flow channel member is airtight.

Meanwhile, the first flow channel and the second flow channel are affixed to each other using an adhesive or the like, and communicate with each other. Although ink does not leak from the surfaces where the first flow channel and the second flow channel are affixed to each other using the adhesive, there are cases where air bubbles in the ink leak from those surfaces. In order to discharge gases that have leaked in this manner to the exterior, it is necessary to provide an atmosphere exposure channel that allows the space in the periphery of the first flow channel and the second flow channel to communicate with the exterior. It is desirable for the atmosphere exposure channel to be a long channel with a small cross-sectional surface area, in order to suppress the evaporation of moisture from within the flow channels.

In the case where such an atmosphere exposure channel is provided in the sealing member, it becomes necessary to secure a region of a certain size in order to form the atmosphere exposure channel. However, if a sealing member provided with an atmosphere exposure channel is pinched by the first flow channel member and the second flow channel member, a load will be placed locally on areas of the first flow channel member and the second flow channel member that oppose the region in which the atmosphere exposure channel is provided, resulting in a risk that those areas will deform.

Furthermore, a nonuniform force is applied to the sealing member between the region in which the atmosphere exposure channel is provided and the other regions of the sealing member. Accordingly, it is necessary to anchor the first flow channel member and the second flow channel member using fastening members such as screws so that a uniform force is applied to the sealing member, which increases the number of components and complicates the assembly process.

Note that this problem is also present in liquid ejecting apparatuses that eject liquids aside from ink.

SUMMARY

It is an advantage of some aspects of the invention to provide a liquid ejecting head and a liquid ejecting apparatus that improve reliability by preventing a load from being applied locally to a flow channel member.

A liquid ejecting head according to an aspect of the invention includes: a main head unit that ejects a liquid; a first flow channel member including a first flow channel through which a liquid introduced into the first flow channel flows; a second flow channel member including a second flow channel through which the liquid to be supplied to the main head unit flows; and a ring-shaped sealing member pinched by the first flow channel member and the second flow channel member. Here, the first flow channel and the second flow channel communicate within a space area defined by the first flow channel member, the second flow channel member, and the sealing member; and an atmosphere exposure channel that connects the space area to the exterior is formed in a joining surface between the sealing member and the first flow channel member or a joining surface between the sealing member and the second flow channel member.

According to this aspect, the atmosphere exposure channel is formed at the joining surface between the sealing member and the first flow channel member or the joining surface between the sealing member and the second flow channel member. Through this, the force at which the sealing member is pinched by the first flow channel member and the second flow channel member is uniform across the entire sealing member, which prevents resistance from the sealing member from being applied locally to the first flow channel member or the second flow channel member. Accordingly, the first flow channel member or the second flow channel member can be prevented from deforming. In this manner, a liquid ejecting head that prevents a load from being applied locally to the flow channel members and improves the reliability is provided. Furthermore, the sealing member only need be crimped between the first flow channel member and the second flow channel member, which renders it unnecessary to anchor those members using fastening members, and in turn makes it possible to reduce the cost of components and simplify the assembly process.

Here, it is preferable for a third flow channel member including a third flow channel to be disposed within the space area, and for the first flow channel and the second flow channel to communicate via the third flow channel. According to this aspect, the first flow channel and the second flow channel can communicate via the third flow channel.

In addition, it is preferable for the atmosphere exposure channel to be provided in a second region of the sealing member, the second region being a region aside from a first region corresponding to a part of the overall circumference of the sealing member; and for the atmosphere exposure channel to have an entry portion that communicates with the space area and an exit portion that communicates with the exterior, and for the entry portion and the exit portion to be disposed so that the first region is located therebetween. According to this aspect, the flow channel in the atmosphere exposure channel can be made the longest. Meanwhile, the flow channel resistance of the atmosphere exposure channel is increased by increasing the flow channel length of the atmosphere exposure channel. Through this, the moisture in the liquid that flows through the first flow channel, the second flow channel, and the third flow channel can be suppressed from evaporating.

In addition, it is preferable for a groove to be formed in the sealing member in the joining surface between the sealing member and the first flow channel member or the joining surface between the sealing member and the second flow channel member; and for a space defined by the groove and the joining surface to serve as the atmosphere exposure channel. Through this, the atmosphere exposure channel can be configured by the sealing member and the first flow channel member or by the sealing member and the second flow channel member.

In addition, it is preferable for protrusion portions that make contact with the first flow channel member or the second flow channel member to be formed on both sides of the groove. Through this, the tightness of the seal of the atmosphere exposure channel configured by the sealing member and the first flow channel member or by the sealing member and the second flow channel member is improved. Improving the tightness of the seal of the atmosphere exposure channel ensures that the atmosphere exposure channel is airtight and makes it possible to discharge gases that have entered into the atmosphere exposure channel to the exterior with certainty, without those gases leaking during the discharge.

In addition, it is preferable for protrusion portions to be formed in the joining surface of the sealing member that is on the opposite side to the joining surface in which the groove is formed. Through this, the tightness of the seal at the border surface between the side of the sealing member on which the atmosphere exposure channel is not provided and the first flow channel member or the second flow channel member is improved. Improving the tightness of the seal at the border surface prevents gases, liquids, or the like from entering/exiting between the space area and the exterior at the border surface.

In addition, it is preferable for the main head unit to include nozzles that eject the liquid, pressure generation chambers that communicate with corresponding nozzles, a pressure generation unit that generates pressure in the pressure generation chambers, individual flow channels that communicate with corresponding pressure generation chambers, a manifold that is shared by the individual flow channels and communicates with the individual flow channels, and a compliance space area formed in a region that corresponds to the manifold; and for the space area to communicate with the compliance space area. Through this, gases that have built up in the compliance space area can be discharged to the exterior via the space area.

Furthermore, another aspect of the invention is a liquid ejecting apparatus including the liquid ejecting head according to the aforementioned aspects.

According to this aspect, a liquid ejecting apparatus that prevents a load from being applied locally to the flow channel members and improves the reliability is provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described in detail hereinafter based on an embodiment. Hereinafter, an ink jet recording head will be given as an example of a liquid ejecting head, and may be called simply a "recording head." Likewise, an ink jet recording apparatus will be given as an example of a liquid ejecting apparatus.

Figure 1:
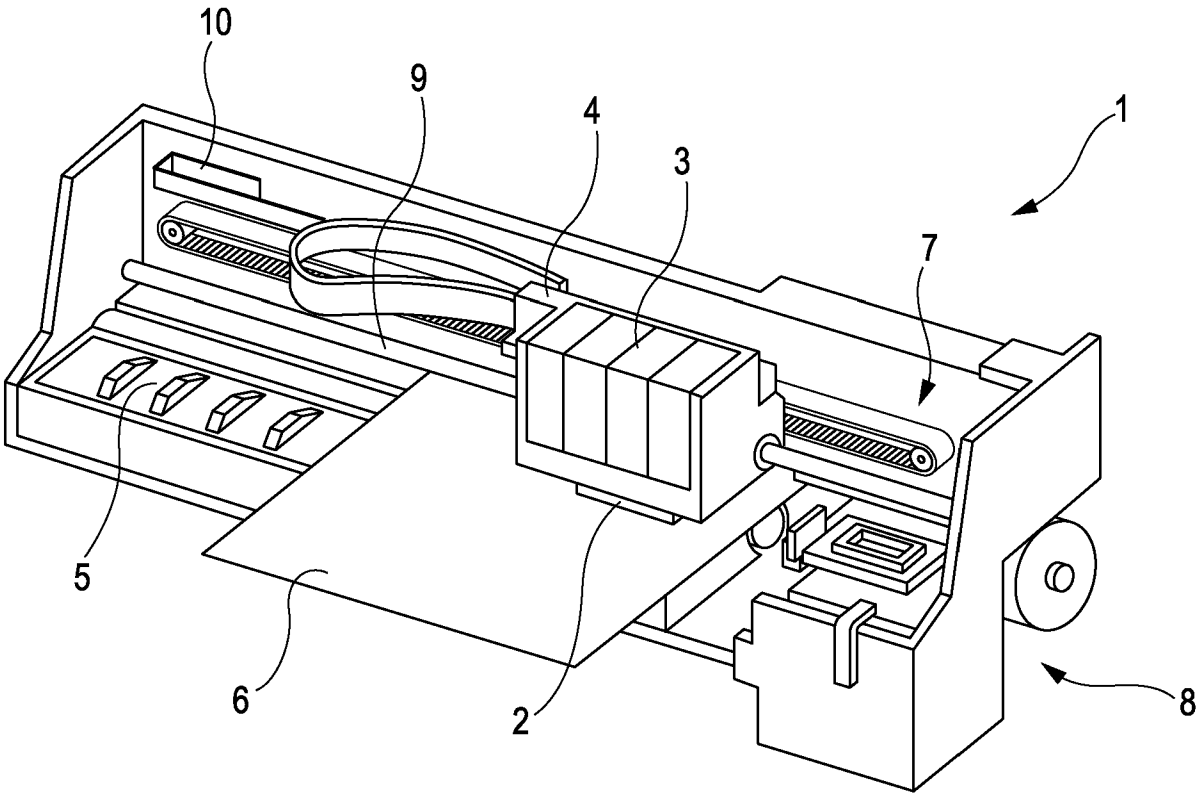
FIG. 1 is a perspective view illustrating the overall configuration of a recording apparatus according to an embodiment.

FIG. 1 is a perspective view illustrating the overall configuration of the ink jet recording apparatus according to this embodiment. An ink jet recording apparatus 1 includes a recording head 2. The recording head 2 is mounted in a carriage 4, and the carriage 4 is provided so as to be capable of moving along a carriage shaft 9.

Transmitting driving force generated by a driving motor (not shown) to the carriage 4 via a plurality of gears and a timing belt 7 moves the carriage 4, in which the recording head 2 is mounted, along the carriage shaft 9.

The position of the carriage 4 along the carriage shaft 9 is detected by a linear encoder 10, and detection signals are sent to a control unit (not shown) as location information. Accordingly, the control unit can control ink ejection operations and the like while recognizing the position of the carriage 4 (the recording head 2) based on the location information from the linear encoder 10.

Furthermore, the ink jet recording apparatus 1 includes a platen 5, and a recording sheet 6, which serves as a recording medium such as paper or the like, that has been supplied by a paper feed mechanism 8 is wrapped upon the platen 5 and transported.

Figure 2:
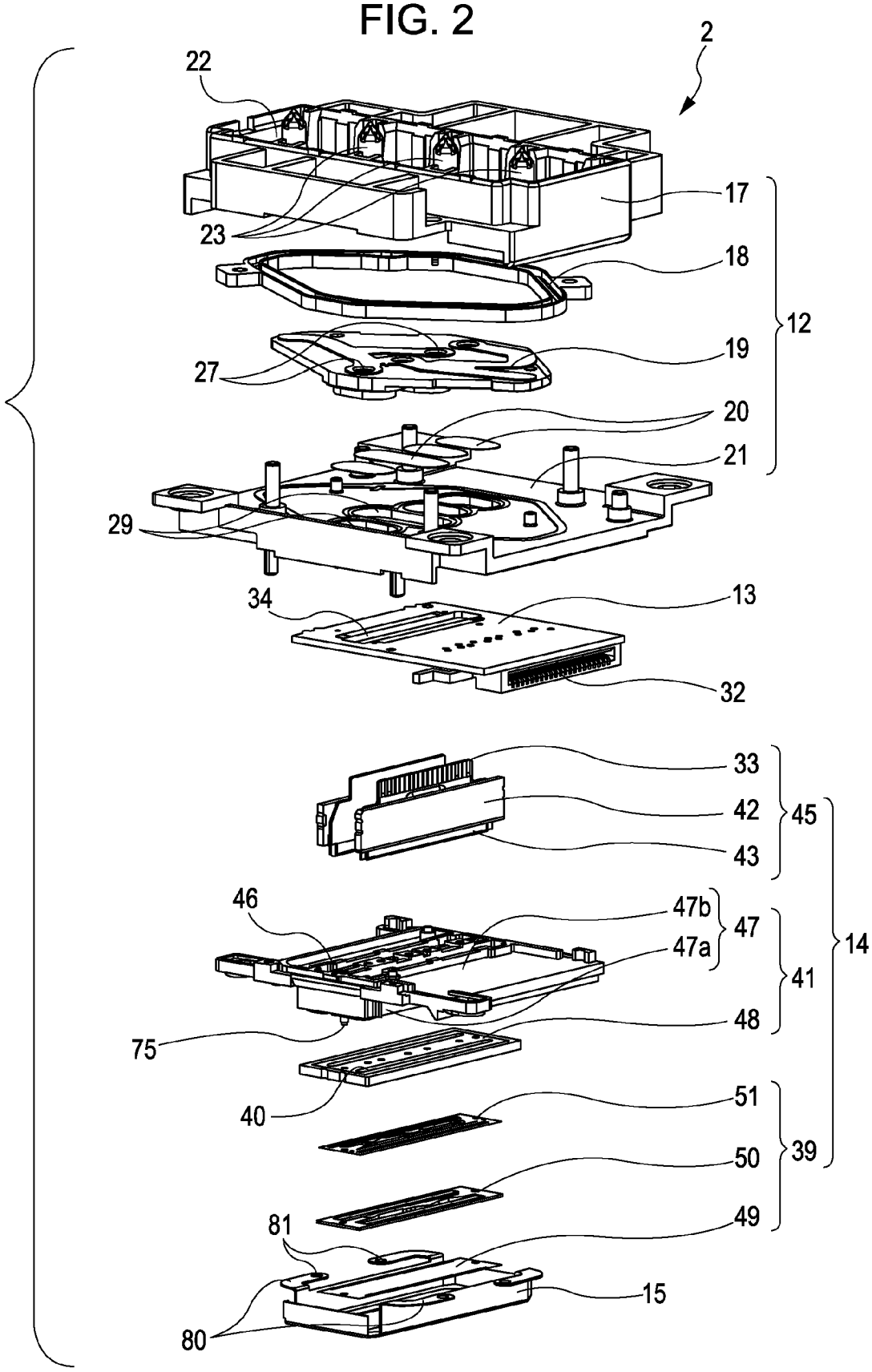
FIG. 2 is an exploded perspective view of a recording head according to an embodiment.
Figure 3:
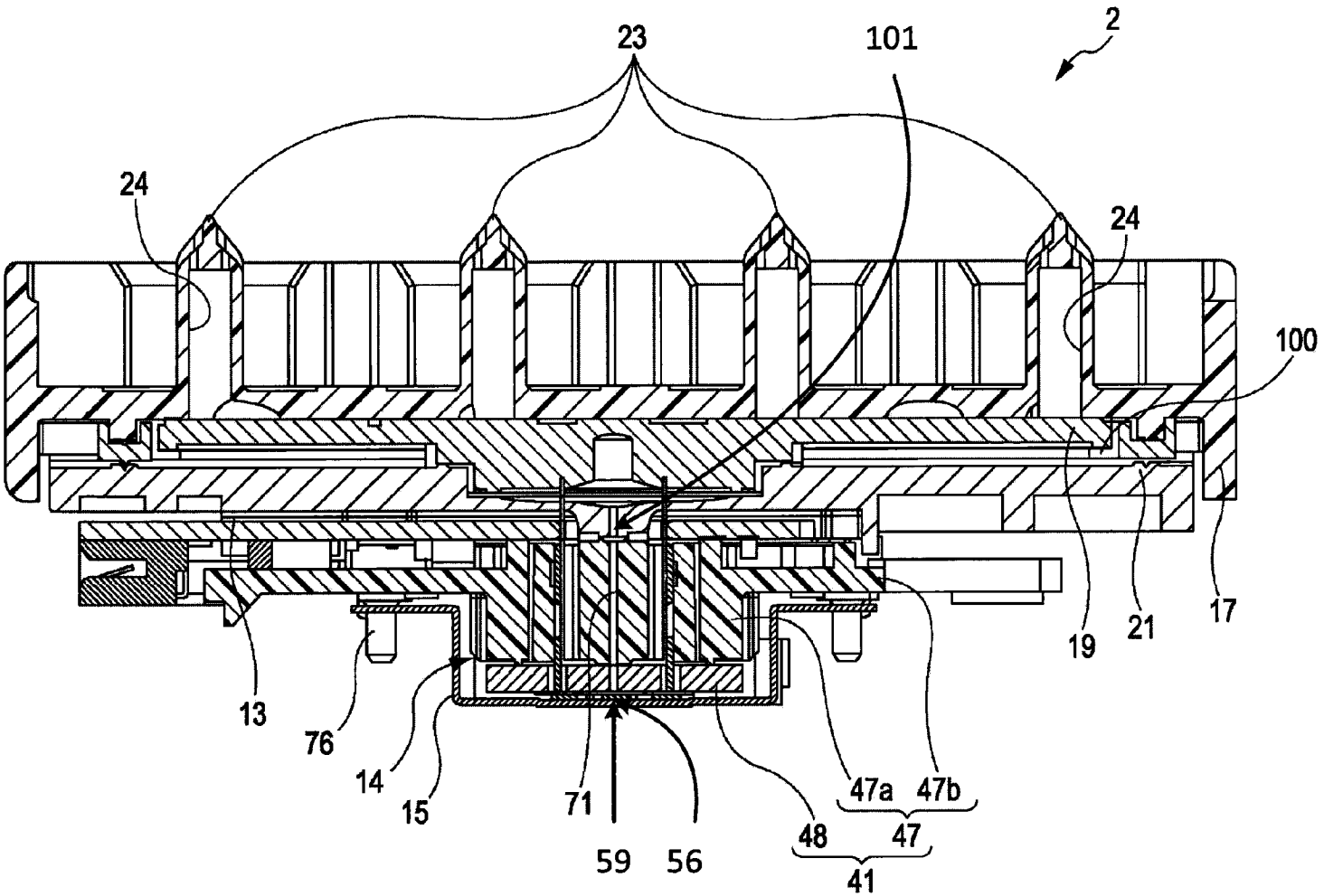
FIG. 3 is a cross-sectional view of the recording head according to the embodiment.

FIG. 2 is an exploded perspective view illustrating the recording head 2, whereas FIG. 3 is a cross-sectional view of the recording head 2. The recording head 2 according to this embodiment includes a flow channel member 12, a circuit board 13, a main head unit 14, and a head cover 15.

The flow channel member 12 is a member in which flow channels for supplying ink from ink cartridges 3 to the main head unit 14 are formed. Specifically, the flow channel member 12 is configured by joining a first flow channel member 17, a second flow channel member 21, and a third flow channel member 19 to each other.

The first flow channel member 17 includes, on its top surface, an ink cartridge mounting portion 22 to which the plurality of ink cartridges 3 can be attached in a removable state. A plurality of ink introduction pins 23 are formed upon the base surface of the ink cartridge mounting portion 22, and are formed corresponding to the respective ink cartridges 3 that are mounted thereon. In this embodiment, four ink introduction pins 23 are arranged in a row so as to correspond to four colors of ink (for example, cyan, magenta, yellow, and black).

First flow channels 24 are formed within the ink introduction pins 23. By inserting the ink introduction pins 23 into the ink cartridges 3, the first flow channels 24 communicate with the interiors of the ink cartridges 3. Meanwhile, the lower ends of the first flow channels 24 are formed so as to be capable of communicating with third flow channels 27 formed in the third flow channel member 19 that is disposed between the first flow channel member 17 and the second flow channel member 21.

The second flow channel member 21 includes second flow channels 29 that pass through the second flow channel member 21 in the thickness direction thereof. The second flow channels 29 have tapered shapes in which the diameters of the flow channels increase toward the first flow channel member 17, and filters 20 are disposed at the openings of the second flow channels 29. In addition, the second flow channels 29 protrude toward the circuit board 13 on the side that faces the circuit board 13, and are inserted into flow channel insertion holes 34 provided in the circuit board 13, which will be mentioned later.

A sealing member 18 has an inner diameter that is greater than the outer diameter of the third flow channel member 19, and is an elastic member that is formed from a resin or the like in a ring shape. The sealing member 18 is pinched by the first flow channel member 17 and the second flow channel member 21. In other words, a space area 100 is defined by the sealing member 18, the first flow channel member 17, and the second flow channel member 21. In this embodiment, the sealing member 18 is heated and then crimped between the first flow channel member 17 and the second flow channel member 21 under pressure. An atmosphere exposure channel that allows the space area 100 to communicate with the exterior is provided in the sealing member 18; detailed descriptions thereof will be given later.

The third flow channel member 19 is disposed within the aforementioned space area 100. The third flow channel member 19 is a plate-shaped member having the four third flow channels 27 that are formed in correspondence with the respective four ink introduction pins 23. The third flow channel member 19 that is disposed within the space area 100 is affixed to the first flow channel member 17 and the second flow channel member 21 using an adhesive (not shown), and is thus anchored in such a state.

The third flow channels 27 provided in the third flow channel member 19 each have one opening that communicates with a corresponding first flow channel 24, whereas the other opening communicates with a corresponding second flow channel 29 via the corresponding filter 20. Note that the filters 20 are used to catch air bubbles, foreign objects, or the like that have intermixed with the ink within the first flow channels 24.

As described thus far, the first flow channel member 17 and the second flow channel member 21 are affixed to each other with the sealing member 18 interposed therebetween, and the first flow channels 24 and second flow channels 29 communicate with each other via the third flow channels 27 within the space area 100 defined by the aforementioned members. According to the flow channel member 12 configured in this manner, ink is supplied from the ink cartridges 3 to liquid flow channels configured by the first flow channels 24, the second flow channels 29, and the third flow channels 27, and that ink is then supplied to the main head unit 14.

The circuit board 13 has electrical components such as ICs, resistors, and so on mounted to the surface thereof. The circuit board 13 is disposed between the second flow channel member 21 and the main head unit 14.

A flexible cable 33 that partially configures a vibrator unit 45 of the main head unit 14 is connected to the circuit board 13. Furthermore, a connector 32 is provided in the circuit board 13, and a signal cable (not shown) is connected to the connector 32. This signal cable is connected to the control unit of the ink jet recording apparatus 1. Driving signals and the like sent from the control unit are transmitted to the circuit board 13 through the signal cable, and the circuit board 13 then drives the vibrator unit 45 via the flexible cable 33.

Meanwhile, the flow channel insertion holes 34 that pass through the circuit board 13 in the thickness direction thereof are formed in the circuit board 13 in regions that correspond to the second flow channels 29. The lower ends of the second flow channels 29 are inserted into the flow channel insertion holes 34, and the lower ends of the second flow channels 29 are connected, below the circuit board 13, to ink supply channels 70 (see FIG. 4) in a main head case unit 47.

Figure 4:
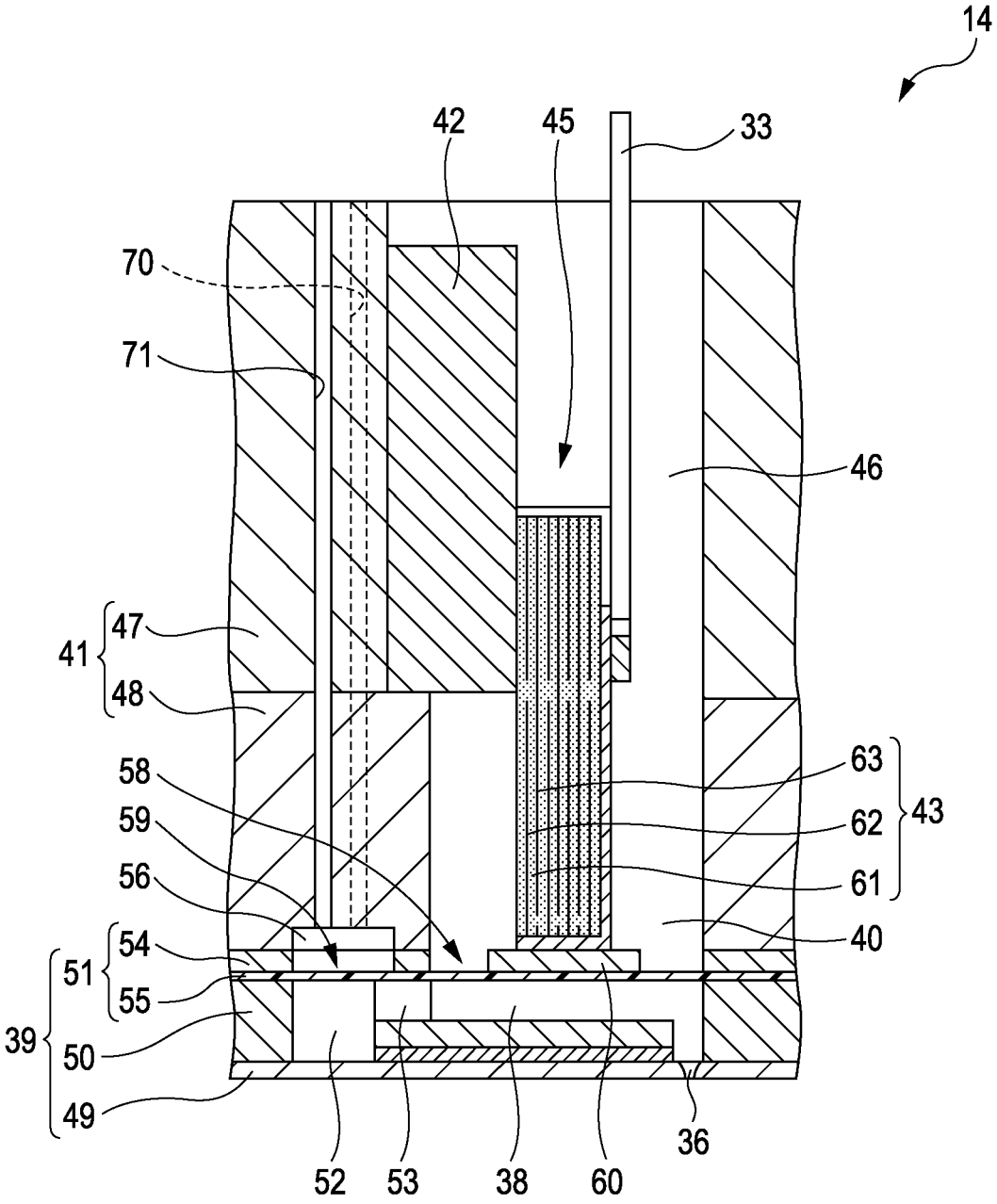
FIG. 4 is a cross-sectional view of a main recording head unit according to the embodiment.

FIG. 4 is a cross-sectional view of the main head unit according to this embodiment. As shown in FIG. 4, the main head unit 14 includes a flow channel unit 39, a head case 41, and the vibrator unit 45, which is an example of a pressure generation unit.

The flow channel unit 39 is configured of a nozzle plate 49, a flow channel formation plate 50, and a vibrating plate 51.

A plurality of pressure generation chambers 38 are arranged in the flow channel formation plate 50 in the width direction thereof, and are divided up by partitions. For example, in this embodiment, two rows in which a plurality of the pressure generation chambers 38 are arranged are provided in the flow channel formation plate 50.

Manifolds 52 for supplying ink to the pressure generation chambers 38 are provided on the outer sides of the respective rows of pressure generation chambers 38, and are provided so as to pass through the flow channel formation plate 50 in the thickness direction thereof. The pressure generation chambers 38 and the manifolds 52 communicate via ink supply channels 53, which are individual flow channels.

In this embodiment, the flow channel formation plate 50 is formed of a silicon single-crystal substrate, and the stated pressure generation chambers 38 and so on provided in the flow channel formation plate 50 are formed by etching the flow channel formation plate 50.

The nozzle plate 49, in which nozzles 36 are formed, is affixed to one of the surfaces of the flow channel formation plate 50. The ends of the pressure generation chambers 38 on the opposite side of the manifolds 52 communicate with the nozzles 36.

Meanwhile, the vibrating plate 51 is affixed to the other side of the flow channel formation plate 50, or in other words, to the surface in which the openings of the pressure generation chambers 38 are provided; the pressure generation chambers 38 are sealed by this vibrating plate 51. The vibrator unit 45, which serves as a pressure generation unit that generates a pressure for ejecting ink droplets within the pressure generation chambers 38, is provided upon this vibrating plate 51. The vibrator unit 45 is anchored in a state in which its end portion makes contact with the surface of the vibrating plate 51.

The vibrator unit 45 is configured of an anchor plate 42, piezoelectric elements 43 that are anchored to the anchor plate 42, and the flexible cable 33 that is connected to the piezoelectric elements 43. The piezoelectric elements 43 are, in this embodiment, configured by layering a piezoelectric material 61 and electrode-forming materials 62 and 63 vertically in an alternating manner in a sandwich-like shape. A non-active region that does not contribute to the vibrations of the piezoelectric elements 43 is affixed to the anchor plate 42.

Here, the vibrating plate 51 with which the tips of the vibrator unit 45 make contact is formed as a composite plate including, for example, an elastic film 55 configured of an elastic member such as a resin film and a support plate 54 configured of, for example, a metal material or the like that supports the elastic film 55; the side of the vibrating plate 51 on which the elastic film 55 is located is affixed to the flow channel formation plate 50.

In addition, island portions 60 with which the tips of the piezoelectric elements 43 make contact are provided in regions of the vibrating plate 51 that oppose corresponding pressure generation chambers 38. In other words, thin-film areas 58 are formed in regions of the vibrating plate 51 that oppose the circumferential areas of the corresponding pressure generation chambers 38, and are formed so as to be thinner than the other regions; the island portions 60 are provided on the inside of these thin-film areas 58.

As with the thin-film areas 58, compliance portions 59, configured by removing the support plate 54 through etching and essentially leaving only the elastic film 55, are provided in regions of the vibrating plate 51 that oppose the manifolds 52. By the elastic film 55 of the compliance portions 59 deforming, the compliance portions 59 absorb pressure changes generated when the pressure within the manifolds 52 changes, and thus fulfill a role for maintaining a constant pressure within the manifolds 52.

The head case 41 is affixed to the vibrating plate 51. The head case 41 is configured of the main head case unit 47 and a reinforcing member 48. The main head case unit 47 is formed of, for example, a resin such as an epoxy resin, and is configured of a hollow box-shaped case portion 47*a* and a plate-shaped portion 47*b* that extends to the sides of the case portion 47*a* from the top of the case portion 47*a*. The reinforcing member 48 is affixed and anchored to the bottom surface of the case portion 47*a*. A housing cavity 46 that communicates with an insertion hole 40 of the reinforcing member 48 is formed within the case portion 47*a*, and part of the vibrator unit 45 is housed within this housing cavity 46. Note that protrusions 75 are formed in the bottom surface of the case portion 47*a*, protruding downward, for positioning the case portion 47*a* relative to the reinforcing member 48 (see FIG. 2).

A first atmosphere communication hole 71 is formed in the main head case unit 47 and the reinforcing member 48, passing therethrough in the thickness direction thereof.

A compliance space portion that allows the compliance portions 59 to deform, is formed in the portions of the reinforcing member 48 that oppose the compliance portions 59. This compliance space portion 56 communicates with the space area 100 via the first atmosphere communication hole 71 in the main head case unit 47. Although details will be given later, the compliance space portion 56 communicates with the space area 100 via the first atmosphere communication hole 71, and is exposed to the atmosphere through the space area 100. Accordingly, the compliance portions 59 can deform favorably in accordance with pressure changes in the manifolds 52.

Meanwhile, the ink supply channels 70 are formed in the main head case unit 47 and the reinforcing member 48, passing therethrough in the thickness direction thereof. One end of each of the ink supply channels 70 is connected to the corresponding second flow channel 29 mentioned above, whereas the other end is connected to the manifold 52.

According to this main head unit 14, when ink droplets are ejected, the capacities of the pressure generation chambers 38 are caused to change due to the deformation of the vibrator unit 45 and the vibrating plate 51, which in turn causes ink droplets to be ejected through predetermined nozzles 36. To be more specific, when ink is supplied to the manifolds 52 from the ink cartridges (not shown), the ink is distributed to the pressure generation chambers 38 via the liquid flow channels in the flow channel member 12 (that is, the first flow channels 24, the second flow channels 29, and the third flow channels 27) and the ink supply channels 70.

In actuality, the piezoelectric elements 43 of the vibrator unit 45 are caused to contract by applying a voltage to the piezoelectric elements 43. As a result, the vibrating plate 51 deforms along with the piezoelectric elements 43, causing the capacities of the pressure generation chambers 38 to increase, thereby pulling ink into the pressure generation chambers 38. After the interior area spanning to the nozzles 36 has been filled with ink, the voltages applied to the piezoelectric elements 43 are released in accordance with recording signals sent from the circuit board 13 through the flexible cable 33. Through this, the piezoelectric elements 43 extend and return to their original states and the vibrating plate 51 also displaces and returns to its original state. As a result, the capacities of the pressure generation chambers 38 contract, the pressure within the pressure generation chambers 38 increases, and ink droplets are ejected through the nozzles 36.

The head cover 15 is attached to the aforementioned main head unit 14. The head cover 15 is a member, made of a metal, that is connected to the main head case unit 47 and that protects the flow channel unit 39, the head case 41, and so on. The head cover 15 is configured of a thin plate member; the head cover 15 encloses the side surfaces of the head case 41, and its lower ends are bent approximately 90° toward the nozzle plate 49, making contact with the surface of the nozzle plate 49 as a result. The surface of the head cover 15 that makes contact with the surface of the nozzle plate 49 is formed in a frame shape that exposes the nozzles 36. Meanwhile, the upper ends of the head cover 15 are provided with flange portions 80 that protrude toward the sides, and head cover reference holes 81 are provided in the flange portions 80 (see FIG. 2). Head cover positioning portions 76 that protrude toward the bottom surface of the main head case unit 47 are inserted into these head cover reference holes 81, and the head cover 15 is positioned as a result.

Figure 5A:
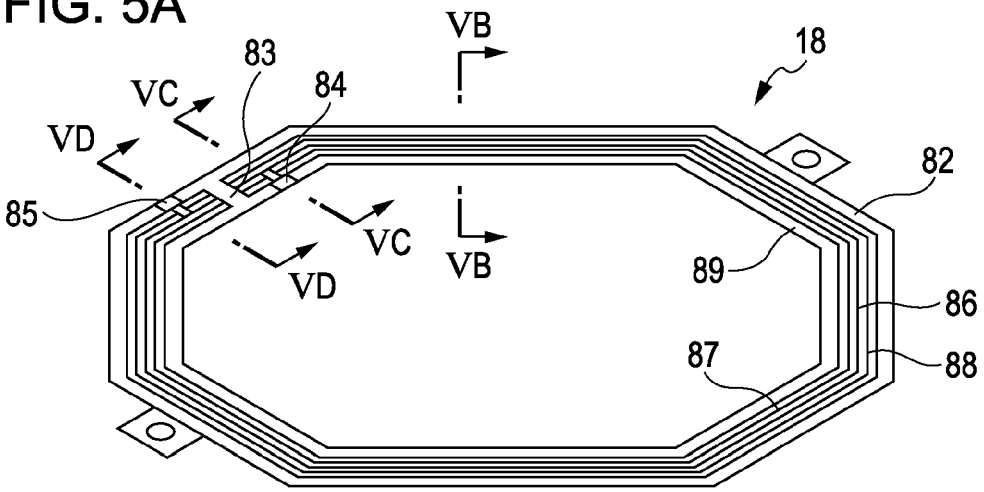
FIGS. 5A through 5D are a plan view and cross-sectional views illustrating a sealing member according to the embodiment.
Figure 5B:
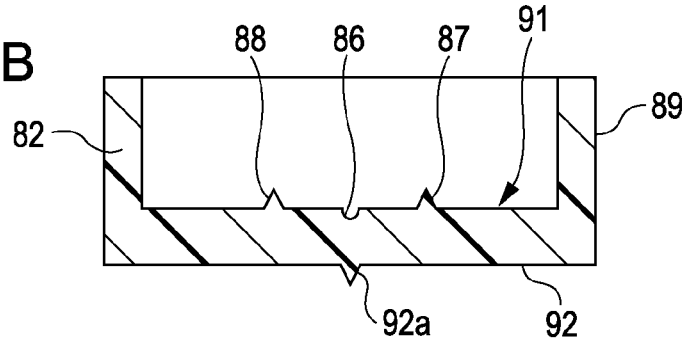
Figure 5C:
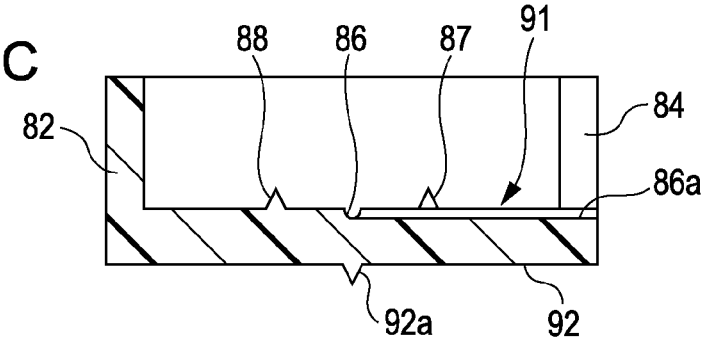

Next, the sealing member 18 will be described in detail. FIG. 5A is a plan view of the sealing member 18; FIG. 5B is a cross-sectional view taken along the VB-VB line shown in FIG. 5A; FIG. 5C is a cross-sectional view taken along the VC-VC line shown in FIG. 5A; and FIG. 5D is a cross-sectional view taken along the VD-VD line shown in FIG. 5A.

As shown in FIG. 5A, the sealing member 18 is a member that configures the atmosphere exposure channel, which will be described later; the sealing member 18 is an elastic member, formed in a ring shape, that has a shape that is greater than the outer diameter of the third flow channel member 19. The third flow channel member 19 is disposed on the inside of the sealing member 18 (see FIGS. 2 and 3), and the entire outer circumference of the third flow channel member 19 is covered by the sealing member 18.

Figure 5D:
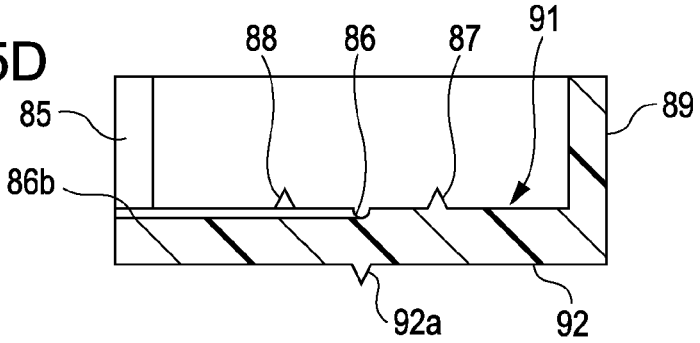

As shown in FIGS. 5B to 5D, an inner wall portion 89 and an outer wall portion 82 that protrude upward are formed in both sides of the upper surface of the sealing member 18, or in other words, in a joining surface 91 on the side of the sealing member 18 that is joined with the first flow channel member 17; the inner wall portion 89 and the outer wall portion 82 are provided so as to span the entire circumference of the sealing member 18. Although details will be given later, a joining portion 17*a* of the first flow channel member 17 is contained between the inner wall portion 89 and the outer wall portion 82, and the joining portion 17*a* makes contact with the joining surface 91.

A partition portion 83 that connects the inner wall portion 89 with the outer wall portion 82 is provided in the sealing member 18. The partition portion 83 is an example of a first region that serves as a part of the overall circumference of the sealing member 18. The region of the sealing member 18 aside from the partition portion 83 serves as a second region, and an atmosphere exposure portion, mentioned later, is formed in the second region.

An atmosphere entry portion 84 is formed in the inner wall portion 89 by cutting out a part thereof in the vicinity of the partition portion 83, whereas an atmosphere exit portion 85 is formed in the outer wall portion 82 by cutting out a part thereof in the vicinity of the partition portion 83. Furthermore, an entry groove portion 86*a* (this corresponds to an "entry portion" in the claims) connected to the atmosphere entry portion 84 and a groove portion 86, and an exit groove portion 86*b* (this corresponds to an "exit portion" in the claims) connected to the atmosphere exit portion 85 and the groove portion 86, are formed in the joining surface 91. The entry groove portion 86*a* and the exit groove portion 86*b* are formed in the second region of the sealing member 18, and are disposed so as to oppose each other with the partition portion 83, which serves as the first region, therebetween.

In addition, the groove portion 86 is formed in the joining surface 91 of the sealing member 18 so as to span the entire circumference of the sealing member 18. Furthermore, an inner protrusion portion 87 and an outer protrusion portion 88 that protrude from the joining surface 91 across the entire circumference of the sealing member 18 are formed on either side of the groove portion 86, respectively. A protrusion portion 92*a* is formed in a joining surface 92 of the sealing member 18 and the second flow channel member 21 so as to span the entire circumference of the sealing member 18.

Figure 6:
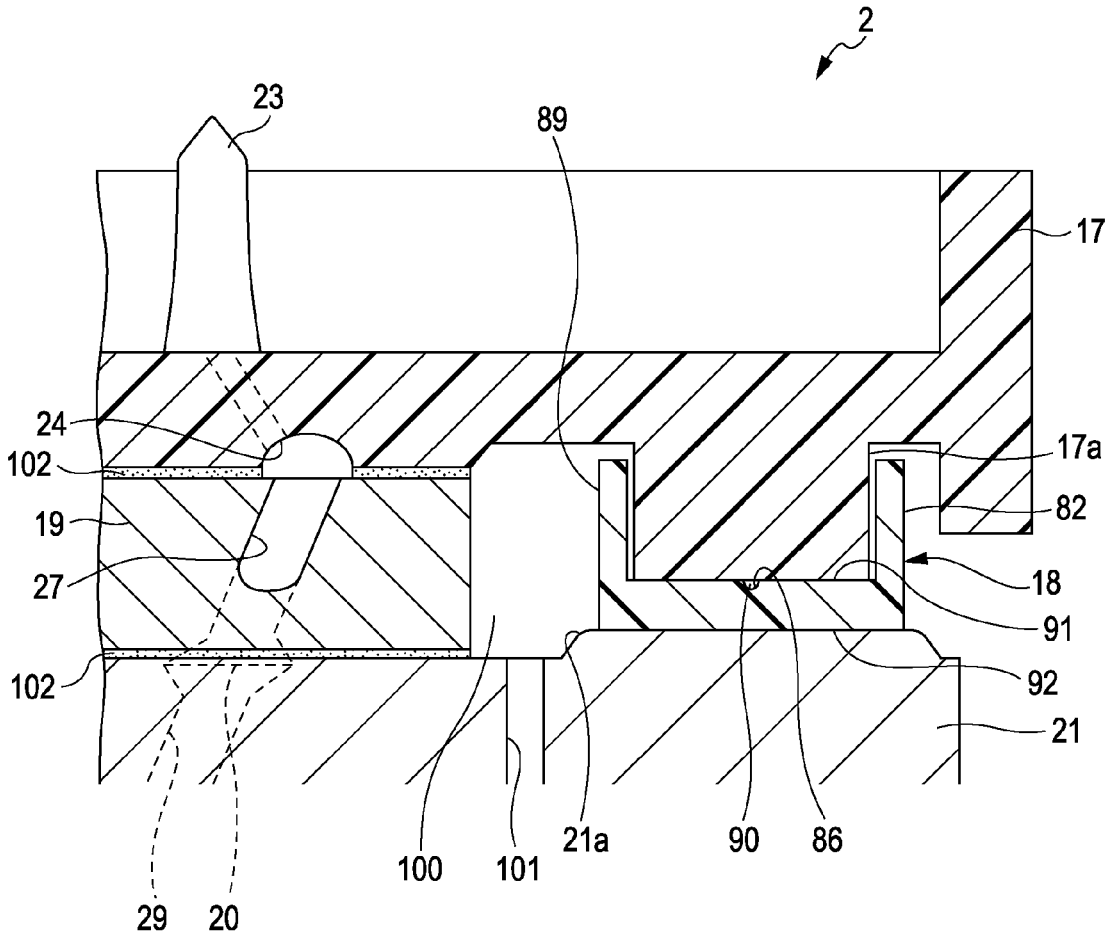
FIG. 6 is a cross-sectional view illustrating the primary elements of the recording head according to the embodiment.

FIG. 6 is a cross-sectional view of primary elements in which the vicinity of the sealing member in the recording head has been enlarged. The sealing member 18 configured as described above is pinched by the first flow channel member 17 and the second flow channel member 21. In other words, the joining portion 17*a* of the first flow channel member 17 is joined with the joining surface 91 of the sealing member 18, and a seal receiving portion 21*a* in the second flow channel member 21 is joined with the joining surface 92.

The joining portion 17*a* protrudes from the bottom surface of the first flow channel member 17 so as to conform to the shape of the sealing member 18, and the width of the joining portion 17*a* is defined so as to be narrower than the gap between the inner wall portion 89 and the outer wall portion 82 of the sealing member 18. The joining portion 17*a* is contained between the inner wall portion 89 and the outer wall portion 82 of the sealing member 18, and makes contact with the entirety of the joining surface 91 including the inner protrusion portion 87 and the outer protrusion portion 88. At this time, the openings of the groove portion 86, the entry groove portion 86*a*, and the exit groove portion 86*b* are sealed by the joining portion 17*a*.

The seal receiving portion 21*a* is a region, in the surface of the second flow channel member 21 on which the third flow channel member 19 is disposed, that protrudes so as to conform to the shape of the sealing member 18. The seal receiving portion 21*a* makes contact with the entirety of the joining surface 92, including the protrusion portion 92*a*.

Note that the sealing member 18 is heated and then crimped between the first flow channel member 17 and the second flow channel member 21 under pressure. Accordingly, the inner protrusion portion 87, the outer protrusion portion 88, and the protrusion portion 92*a* are compressed.

By interposing the sealing member 18 between the first flow channel member 17 and the second flow channel member 21 in this manner, the space area 100 is defined by those members. The third flow channel member 19 is then disposed within the space area 100, and the first flow channels 24 and second flow channels 29 communicate with each other via the third flow channels 27. Although details will be given later, it should be noted that a second atmosphere communication hole 101 that communicates with the first atmosphere communication hole 71 of the main head unit 14 (see FIG. 4) is formed in the second flow channel member 21, and the second atmosphere communication hole 101 communicates with the space area 100. In other words, the compliance space portion 56 that opposes the compliance portions 59 of the main head unit 14 communicates with the space area 100 via the first atmosphere communication hole 71 and the second atmosphere communication hole 101.

Note that because the second flow channel member 21 is joined to the joining surface 92 by compressing the protrusion portion 92*a* provided in the joining surface 92 of the sealing member 18, the tightness of the seal at the border surface is improved. Improving the tightness of the seal at the border surface prevents gases, liquids, or the like from entering/exiting between the space area 100 and the exterior via the border surface.

By joining the first flow channel member 17 to the joining surface 91 of the sealing member 18, an atmosphere exposure channel 90 is configured from the groove portion 86, the entry groove portion 86*a*, the exit groove portion 86*b*, and the first flow channel member 17 (the joining portion 17*a*). The atmosphere exposure channel 90 is a flow channel for gases provided in the sealing member 18.

Here, the third flow channel member 19 is affixed to the first flow channel member 17 and the second flow channel member 21 using, for example, an adhesive 102. Accordingly, ink does not leak at the border surface where the third flow channels 27, the first flow channels 24, and the second flow channels 29 are joined. However, gases such as air bubbles contained in the ink will enter into the space area 100 from the border surface where those channels are joined.

The atmosphere exposure channel 90 discharges gases that have entered into the space area 100 to the exterior. This will be described in detail using FIGS. 7A through 7D.

Figure 7A:
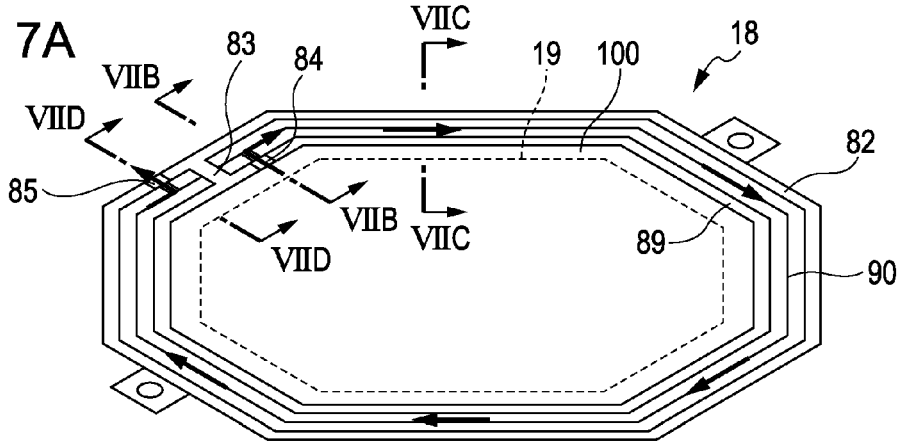
FIGS. 7A through 7D are a plan view and cross-sectional views of an atmosphere exposure channel according to the embodiment.
Figure 7B:
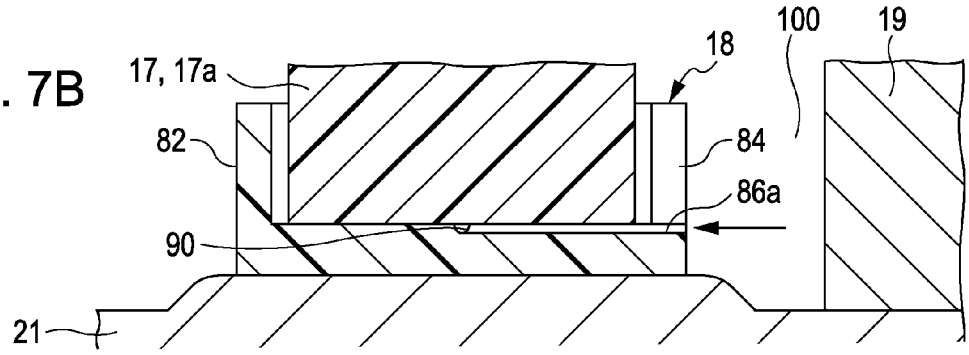
Figure 7C:
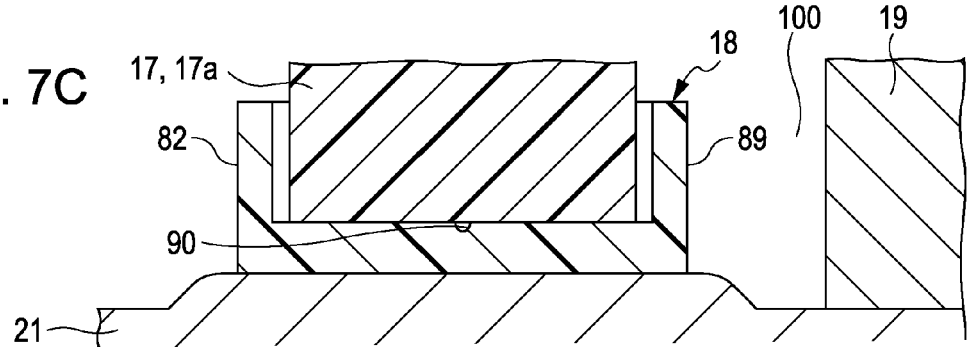
Figure 7D:
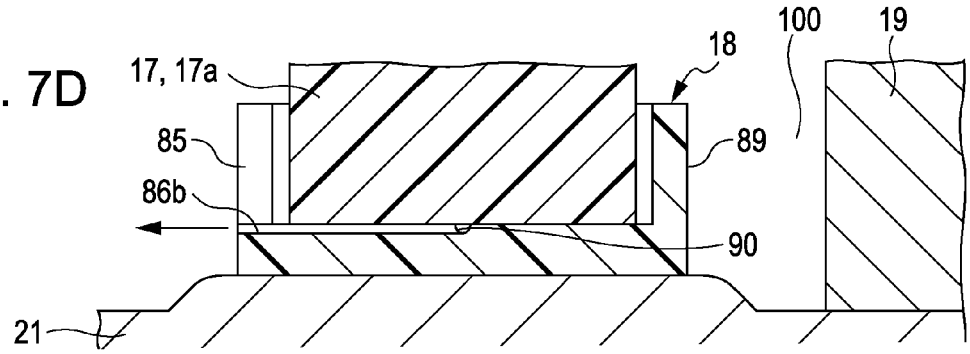

FIG. 7A is a plan view illustrating the atmosphere exposure channel; FIG. 7B is a cross-sectional view taken along the VIIB-VIIB line shown in FIG. 7A; FIG. 7C is a cross-sectional view taken along the VIIC-VIIC line shown in FIG. 7A; and FIG. 7D is a cross-sectional view taken along the VIID-VIID line shown in FIG. 7A. Note that part or all of the first flow channel member 17 is not shown in these diagrams.

As shown in FIGS. 7A and 7*b*, the entry groove portion 86*a* that partially configures the atmosphere exposure channel 90 is connected to the atmosphere entry portion 84, and thus the atmosphere exposure channel 90 communicates with the space area 100. Accordingly, gases within the space area 100 advance into the atmosphere exposure channel 90 via the entry groove portion 86*a*, as indicated by the arrow.

As shown in FIGS. 7A and 7C, the atmosphere exposure channel 90 is divided by the partition portion 83, and thus gases advance in the opposite direction as the partition portion 83 (clockwise, in FIG. 7A).

Meanwhile, as shown in FIGS. 7A and 7D, the exit groove portion 86*b* that partially configures the atmosphere exposure channel 90 is connected to the atmosphere exit portion 85, and thus the atmosphere exposure channel 90 communicates with the exterior. Accordingly, gases are discharged from the atmosphere exposure channel 90 in the direction indicated by the arrow.

In this manner, gases that have entered into the space area 100 are discharged to the exterior via the atmosphere exposure channel 90. In other words, forming the atmosphere exposure channel 90 makes it possible to prevent gases from building up within the space area 100.

Note that because the first flow channel member 17 is joined to the joining surface 91 by compressing the inner protrusion portion 87 and the outer protrusion portion 88 provided in the joining surface 91 of the sealing member 18, the tightness of the seal at the border surfaces is improved. Improving the tightness of the seal at this border surface ensures that the atmosphere exposure channel 90 is airtight and makes it possible to discharge gases that have entered into the atmosphere exposure channel 90 to the exterior with certainty, without those gases leaking during the discharge.

Furthermore, the atmosphere exposure channel 90 is provided in the second region of the sealing member 18 that is formed in a ring shape, the second region spanning the entire circumference of the sealing member 18 aside from the part corresponding to the first region (the partition portion 83). In other words, the atmosphere exposure channel 90 is provided spanning almost the entire circumference of the sealing member 18. On the other hand, the entry groove portion 86*a* and the exit groove portion 86*b* are provided with the partition portion 83 therebetween, and thus an air entry/exit is provided essentially at both ends of the atmosphere exposure channel 90. In other words, it is possible to form an atmosphere exposure channel having the longest possible flow channel length for an atmosphere exposure channel that can be formed in the ring-shaped sealing member 18. Note that it is desirable to form the partition portion 83 as thin as possible in order to increase the flow channel length of the atmosphere exposure channel, and thus it is desirable for the entry groove portion 86*a* and the exit groove portion 86*b* to be as close to each other as possible with the partition portion 83 therebetween.

The flow channel resistance of the atmosphere exposure channel is increased by increasing the flow channel length of the atmosphere exposure channel 90 in this manner. Accordingly, the moisture in the ink that flows through the first flow channels 24, the second flow channels 29, and the third flow channels 27 can be suppressed from evaporating. Incidentally, in the case where there is no flow channel resistance, such as a case where the third flow channel member 19 is exposed to the exterior, it is easy for the moisture in the ink to evaporate from the surfaces at which the first flow channel member 17, the second flow channel member 21, and the third flow channel member 19 are joined; this in turn causes a problem in that the ink will thicken.

In this embodiment, the compliance space portion 56 that opposes the compliance portions 59 in the main head unit 14 communicates with the space area 100 via the second atmosphere communication hole 101 provided in the second flow channel member 21. The volatile components of the ink sometimes permeate the elastic film 55 of the compliance portions 59 and accumulate in the compliance space portion 56. However, such volatile components are discharged to the exterior through the first atmosphere communication hole 71 (see FIG. 4), the second atmosphere communication hole 101, the space area 100, and the atmosphere exposure channel 90. This makes it possible to maintain functionality in which pressure is prevented from building up in the compliance space portion 56, pressure changes caused by the elastic film 55 of the compliance portions 59 deforming are absorbed, and a constant pressure is maintained in the manifolds 52.

As described thus far, with the recording head 2 according to this embodiment, the atmosphere exposure channel 90 is formed by providing the groove portion 86 in the sealing member 18 and joining the sealing member 18 to the first flow channel member 17. Because the atmosphere exposure channel 90 is formed at the surface where the sealing member 18 and the first flow channel member 17 are joined to each other, the force at which the sealing member 18 is pinched by the first flow channel member 17 and the second flow channel member 21 is uniform across the entire sealing member 18. Accordingly, resistance from the sealing member 18 is prevented from being applied locally to the first flow channel member 17 or the second flow channel member 21, which makes it possible to prevent the first flow channel member 17 or the second flow channel member 21 from deforming. In other words, the recording head 2 that prevents a load from being applied locally to the first flow channel member 17 and the second flow channel member 21 and improves the reliability is provided.

Incidentally, in the case where a region for forming the atmosphere exposure channel 90 is provided separately in an area aside from the region where the sealing member 18 is joined to the first flow channel member 17 and the second flow channel member 21 (that is, the joining surfaces 91 and 92), such as a case where a flat-shaped region is provided on the inner side of the ring-shaped sealing member 18 and a groove portion is provided in the surface of that region, the situation is as follows. Although the groove portion provided in the flat-shaped region and the first flow channel member 17 are brought into tight contact in order to secure the atmosphere exposure channel, the flat-shaped region has a different shape and surface area from the ring-shaped areas, and thus experiences a force that is greater than or equal to the force exerted on the joining surfaces 91 and 92. Accordingly, a force is applied locally to the part of the first flow channel member 17 that opposes the flat-shaped region, which causes that part to deform.

In such a case, the first flow channel member 17 and the second flow channel member 21 are anchored using fastening members such as screws or the like in order to apply a sufficient force to the flat-shaped region; however, in the embodiment, the sealing member 18 only need be crimped between the first flow channel member 17 and the second flow channel member 21, which renders such fastening members unnecessary, and in turn makes it possible to reduce the cost of components and simplify the assembly process.

Figure 8A:
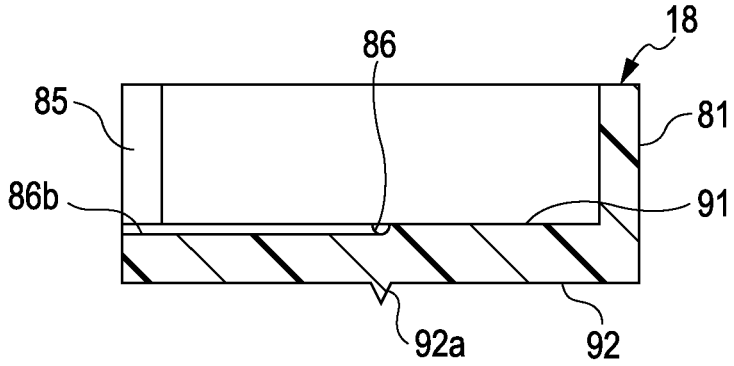
FIGS. 8A and 8B are plan views illustrating a variation on the sealing member according to the embodiment.

Although in the sealing member 18 of the recording head 2 according to the aforementioned embodiment, the inner protrusion portion 87 and the outer protrusion portion 88 are formed in the joining surface 91 and the protrusion portion 92*a* is formed in the joining surface 92, it should be noted that the invention is not limited thereto. For example, as shown in FIG. 8A, the inner protrusion portion 87 and the outer protrusion portion 88 may not be provided in the joining surface 91, and the protrusion portion 92*a* may then be provided in the joining surface 92. In addition, although not explicitly shown, the inner protrusion portion 87 and the outer protrusion portion 88 may be provided in the joining surface 91 and the protrusion portion 92*a* may not be provided in the joining surface 92. Furthermore, it is also possible to provide none of the inner protrusion portion 87, the outer protrusion portion 88, and the protrusion portion 92*a*.

Figure 8B:
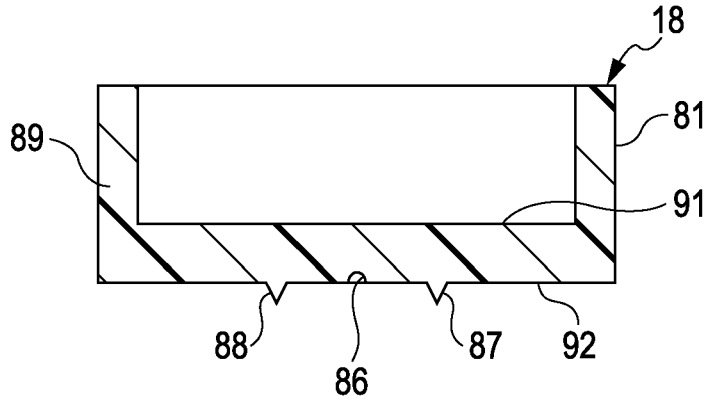

As shown in FIG. 8B, the groove portion 86 may be provided in the joining surface 92 that makes contact with the second flow channel member 21. In this case, the inner protrusion portion 87 and the outer protrusion portion 88 may be provided in the joining surface 92.

In addition, although the third flow channel member 19 is disposed in the space area 100 and the first flow channels 24 and the second flow channels 29 communicate with each other via the third flow channels 27 in the third flow channel member 19, the invention is not limited thereto.

Figure 9:
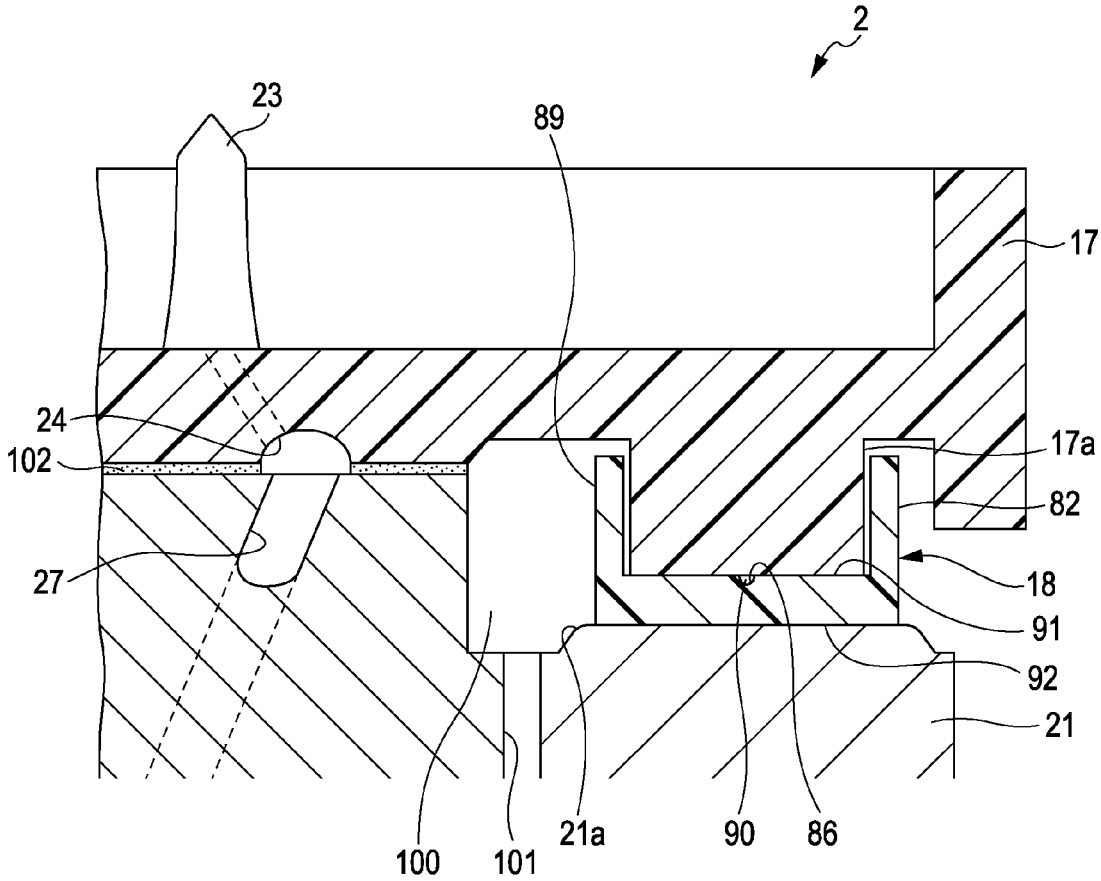
FIG. 9 is a cross-sectional view of the primary elements in a variation on the recording head according to the embodiment.

For example, as shown in FIG. 9, the first flow channel member 17 and the second flow channel member 21 may be affixed to each other in the space area 100 and the first flow channels 24 and the second flow channels 29 may communicate with each other directly. Even in this case, bubbles in the ink leak from the border surface where the first flow channel member 17 and the second flow channel member 21 are affixed using the adhesive 102, and enter into the space area 100. This gas that has entered into the space area 100 can also be discharged to the exterior via the atmosphere exposure channel 90.

Although the atmosphere exposure channel 90 is provided spanning almost the entire circumference of the sealing member 18 in this embodiment, the invention is not limited thereto. For example, the atmosphere exposure channel 90 may be provided spanning only part of the sealing member 18. Furthermore, although the entry groove portion 86*a* and the exit groove portion 86*b* of the atmosphere exposure channel 90 are disposed opposing each other with the partition portion 83 therebetween, the invention is not limited thereto. For example, the partition portion 83 may be omitted and the atmosphere exposure channel may be provided spanning the entire circumference of the sealing member 18, and the atmosphere exposure channel may be configured by forming an entry portion (this corresponds to the entry groove portion 86*a*) and an exit portion (this corresponds to the exit groove portion 86*b*) that communicate with the atmosphere exposure channel in a desired location of the sealing member. In this case, there are two channels spanning from the entry portion to the exit portion of the atmosphere exposure channel. In other words, air that has entered from the entry portion reaches the exit portion in the clockwise or counter-clockwise direction, and is then discharged to the exterior. Furthermore, the flow channel that connects the atmosphere exposure channel and the space area (this corresponds to the entry groove portion 86*a*), the flow channel that connects the atmosphere exposure channel and the exterior (this corresponds to the exit groove portion 86*b*), and so on are not limited to a single channel each, and may be implemented as a plurality of channels.

Meanwhile, although only one atmosphere exposure channel 90 is provided in the embodiment, a plurality of atmosphere exposure channels 90 may be provided instead. For example, two atmosphere exposure channels 90 may be configured by providing the groove portions 86 in both surfaces of the sealing member 18 and joining the sealing member 18 to the first flow channel member 17 and the second flow channel member 21.

In addition, although the space area 100 communicates with the compliance space portion 56 that opposes the compliance portions 59, a configuration in which the compliance space portion 56 communicates with the space area 100 is not absolutely necessary.

Although the aforementioned embodiment describes longitudinally-vibrating piezoelectric elements 43 that are configured by layering the piezoelectric material 61 and the electrode-forming materials 62 and 63 in an alternating manner and that extend and contract in the longitudinal direction as an example of a pressure generation unit that causes a pressure change in a flow channel (pressure generation chamber), the pressure generation unit is not particularly limited thereto, and flexurally-vibrating piezoelectric elements that are configured by layering the piezoelectric material 61 and the electrode-forming materials 62 and 63 in an alternating manner and whose one end in the layering direction makes contact with the vibrating plate 51 may be employed instead.

Furthermore, for example, a thin-film piezoelectric element in which a lower electrode, a piezoelectric layer configured of a piezoelectric material, and an upper electrode are formed through deposition and lithography can be employed, or a thick-film piezoelectric element formed through a method such as green sheet lamination or the like can be employed, as the pressure generation unit. Moreover, a device in which thermal elements are disposed within the pressure generation chambers and liquid droplets are ejected through the nozzle openings due to bubbles forming as a result of heat from the thermal elements, a device that generates static electricity between a vibrating plate and an electrode, with the resulting static electricity force causing the vibrating plate to deform and liquid droplets to be ejected through the nozzle openings, and so on can also be used as the pressure generation unit.

In addition, although the above descriptions of the ink jet recording apparatus 1 illustrate an example in which the recording head 2 is mounted in the carriage 4 and moves along the main scanning direction, the invention is not particularly limited thereto; for example, the invention can also be applied in a so-called line-type recording apparatus, in which the recording head 2 is anchored and printing is performed simply by moving the recording sheet 6, which is paper or the like, in the sub scanning direction.

Although the stated embodiment describes an ink jet recording head as an example of a liquid ejecting head and an ink jet recording apparatus as an example of a liquid ejecting apparatus, the invention applies generally to all types of liquid ejecting heads and liquid ejecting apparatuses, and can of course be applied in liquid ejecting heads, liquid ejecting apparatuses, and so on that eject liquids aside from ink. Various types of recording heads used in image recording apparatuses such as printers, coloring material ejecting heads used in the manufacture of color filters for liquid-crystal displays and the like, electrode material ejecting heads used in the formation of electrodes for organic EL displays, FEDs (field emission displays), and so on, bioorganic matter ejecting heads used in the manufacture of biochips, and so on can be given as other examples of liquid ejecting heads; the invention can also be applied in liquid ejecting apparatuses that include such liquid ejecting heads.

The entire disclosure of Japanese Patent Application No. 2011-114053, filed May 20, 2011 is incorporated by reference herein.

What is claimed is:

1. A liquid ejecting head comprising:

a main head unit that ejects a liquid;

a first flow channel member including a first flow channel through which a liquid to be introduced into the first flow channel flows;

a second flow channel member including a second flow channel through which the liquid to be supplied to the main head unit flows;

a ring-shaped sealing member pinched by the first flow channel member and the second flow channel member; and a space area defined by the first flow channel member, the second flow channel member, and the ring-shaped sealing member, wherein the first flow channel and the second flow channel are enclosed with the ring-shaped sealing member, an atmosphere exposure channel that connects the space area to the exterior is formed in a joining surface between the sealing member and one of the first flow channel member and the second flow channel member along the joining surface, and a direction of the atmosphere exposure channel is different from a direction of the first flow channel and a direction of the second flow channel.

2. The liquid ejecting head according to claim 1, wherein a third flow channel member including a third flow channel is disposed within the space area; and the first flow channel and the second flow channel communicate via the third flow channel.

3. The liquid ejecting head according to claim 1, wherein the atmosphere exposure channel is provided at an overall circumference of the ring-shaped sealing member except a first region of the ring-shaped sealing member; and the atmosphere exposure channel has an entry portion that communicates with the space area and an exit portion that communicates with the exterior, and the entry portion and the exit portion are disposed so that the first region is located therebetween.

4. The liquid ejecting head according to claim 1, wherein a groove is formed in the ring-shaped sealing member in the joining surface; and the atmosphere exposure channel is formed between the groove and the joining surface.

5. The liquid ejecting head according to claim 4, wherein protrusion portions that make contact with the first flow channel member or the second flow channel member are formed on both sides of the groove.

6. The liquid ejecting head according to claim 4, wherein protrusion portions are formed in a joining surface between the ring-shaped sealing member and the other of the first flow channel member and the second flow channel member.

7. The liquid ejecting head according to claim 1, wherein the main head unit includes nozzles that eject the liquid, pressure generation chambers that communicate with corresponding nozzles, a pressure generation unit that generates pressure in the pressure generation chambers, individual flow channels that communicate with corresponding pressure generation chambers, a manifold that is shared by the individual flow channels and communicates with the individual flow channels, and a compliance space area formed in a region that corresponds to the manifold; and the space area communicates with the compliance space area.

8. A liquid ejecting apparatus comprising the liquid ejecting head according to claim 1.

9. A liquid ejecting apparatus comprising the liquid ejecting head according to claim 2.

10. A liquid ejecting apparatus comprising the liquid ejecting head according to claim 3.

11. A liquid ejecting apparatus comprising the liquid ejecting head according to claim 4.

12. A liquid ejecting apparatus comprising the liquid ejecting head according to claim 5.

13. A liquid ejecting apparatus comprising the liquid ejecting head according to claim 6.

14. A liquid ejecting apparatus comprising the liquid ejecting head according to claim 7.

* * * * *